US006236953B1

(12) United States Patent
Segal

(10) Patent No.: US 6,236,953 B1
(45) Date of Patent: May 22, 2001

(54) SYSTEM FOR MONITORING COMPLIANCE WITH APPARATUSES HAVING PREDETERMINED OPERATING PARAMETERS

(75) Inventor: Noel B. Segal, Rockville, MD (US)

(73) Assignee: Compliance Control, Inc., Rockville, MD (US)

( * ) Notice: Subject to any disclaimer, the term of this patent is extended or adjusted under 35 U.S.C. 154(b) by 0 days.

(21) Appl. No.: 09/027,902

(22) Filed: Feb. 23, 1998

Related U.S. Application Data

(63) Continuation-in-part of application No. 08/603,418, filed on Feb. 20, 1996, now Pat. No. 5,793,653, which is a continuation-in-part of application No. 08/273,872, filed on Jul. 12, 1994, now abandoned, and a continuation-in-part of application No. 08/300,184, filed on Sep. 2, 1994, now abandoned.

(51) Int. Cl.[7] ..... G04F 5/00

(52) U.S. Cl. ..... 702/127; 702/177; 702/178; 702/50

(58) Field of Search ..... 702/127, 45, 50, 702/55, 114, 121–123, 130–132, 136, 176–179, 183, 187, 188, FOR 103, FOR 104, FOR 121, FOR 134, FOR 135, FOR 139, FOR 142, FOR 154, FOR 155, FOR 170, FOR 171; 377/20, 21, 25, 19; 340/573.1, 691.6, 691.5, 539, 572.3, 540, 541, 567, 588, 589, 606, 618, 622, 825.31, 825.32, 825.34, 825.3, 825.016; 700/3, 9, 10, 11, 14, 19, 79, 80, 278, 281, 282, 283, 285, 299, 300, 306; 4/623, 624, 304, 305, DIG. 3, 406, 626, 619, 628, 668, 638; 134/57 R, 58 R, 103.3, 104.1, 95.3; 222/52, 54, 638, 639; 624/624.11–624.13, 624.15, 624.21, 624.27; 422/105, 106, 116

(56) References Cited

U.S. PATENT DOCUMENTS

| | | | | |
|---|---|---|---|---|
| 3,997,873 | | 12/1976 | Thornton | 340/825.31 |
| 4,606,085 | | 8/1986 | Davies | 4/623 |
| 4,896,144 | | 1/1990 | Bogstad | 340/691.6 |
| 4,942,631 | | 7/1990 | Rosa | 4/623 |
| 5,016,172 | | 5/1991 | Dessertine | 600/300 |
| 5,031,258 | * | 7/1991 | Shaw | 4/624 |
| 5,060,323 | | 10/1991 | Shaw | 4/623 |
| 5,086,526 | * | 2/1992 | Van Marcke | 4/623 |
| 5,184,642 | | 2/1993 | Powell | 137/607 |
| 5,202,666 | | 4/1993 | Knippscheer | 340/573.1 |
| 5,265,628 | | 11/1993 | Sage et al. | 134/58 R |
| 5,610,589 | | 3/1997 | Evans et al. | 340/573.1 |
| 5,670,945 | | 9/1997 | Applonie | 340/573.1 |
| 5,781,942 | * | 7/1998 | Allen et al. | 4/628 |
| 5,812,059 | | 9/1998 | Shaw et al. | 340/573.1 |
| 5,966,753 | | 10/1999 | Gauthier et al. | 4/623 |

FOREIGN PATENT DOCUMENTS

| | | |
|---|---|---|
| 0 758 702 A1 | 2/1997 | (EP) . |
| WO 93/10311 | 5/1993 | (WO) . |

* cited by examiner

*Primary Examiner*—Hal Wachsman
(74) *Attorney, Agent, or Firm*—Finnegan, Henderson, Farabow, Garrett & Dunner, L.L.P.

(57) ABSTRACT

A system is provided for monitoring use of an apparatus to determine compliance with predetermined operating parameters by users. The system includes a first data collection device for determining the identity of the user of the apparatus during each use for comparison to the predetermined operating parameters, a second data collection device for determining the time of use of the apparatus by the user for comparison to the operating parameters, a third device for providing supplies or service to the user in a predetermined sequence, a data collection device for determining whether the person using the apparatus has completed the predetermined sequence, and a device for evaluating compliance with the operating parameters by the person based on the determined identity of the person and the sequence completion information.

40 Claims, 6 Drawing Sheets

SYSTEM FOR MONITORING COMPLIANCE WITH APPARATUSES HAVING PREDETERMINED OPERATING PARAMETERS

PRIOR APPLICATIONS

The present application is a continuation-in-part of U.S. application Ser. No. 08/603,418, filed Feb. 20, 1996 (now U.S. Pat. No. 5,793,653), which is a continuation-in-part of U.S. application Ser. No. 08/273,872, filed Jul. 12, 1994 (now abandoned), and U.S. application Ser. No. 08/300,184, filed Sep. 2, 1994 (now abandoned), all of which are incorporated by reference herein.

BACKGROUND OF THE INVENTION

The present invention is directed to a system for ensuring that users of an apparatus comply with predetermined operating parameters.

Field of the Invention

In many industries, particularly those relating to the processing and preparation of food, contamination of the product by workers is a major public health threat. Government health inspectors and industry management have therefore sought to require workers to wash their hands before handling the product and after their hands may have come into contact with any substance that could contaminate the product.

The U.S. Food and Drug Administration's Food Code provides guidelines for preparing food and preventing food-borne illness. Retail outlets such as restaurants and grocery stores and other institutions such as nursing homes are subject to the Food Code. The Food Code specifies that certain employees must periodically (e.g., every thirty minutes) follow a defined cleaning procedure (e.g., clean hands and exposed portions of arms for at least twenty seconds) (Food Code, § 2-301.12). The Food Code also specifies that employees must follow a more rigorous cleaning procedure after using the bathroom (Food Code, § 2-301.13).

In addition to requiring employees to wash their hands, the Food Code requires their employer to monitor the employees' hand washing. For example, the Food Code requires implementation of a Hazard Analysis Critical Control Point Plan (HACCP Plan), which is to be monitored by a "person in charge." An HACCP Plan must include a method for monitoring and a frequency for monitoring and controlling each critical point, a method and a frequency to routinely verify that employees are following standard operating procedures and monitoring critical control points, and a system for maintaining records to demonstrate that the HACCP Plan is properly operated and managed (Food Code, § 8-201.14).

Local, state, and federal regulators use the Food Code as a model to help develop or update their own food safety rules and to be consistent with national food regulatory policy. Also, many of the over one million retail food establishments attempt to apply Food Code provisions to their own operations, although the Food Code is neither federal law nor federal regulation and does not preempt state or local laws.

Despite such extensive efforts to ensure that proper hand washing is performed, more than a quarter of all food-borne illnesses (6,000,000 reported cases, an estimated 81,000,000 unreported cases, and 9,000 deaths in 1992) are thought to be due to improper hand washing. Similar concerns exist in the health care industry, where improper hand washing is believed to cause over 500,000 hospital-related (nosocomial) infections each year.

Monitoring the equipment used in the preparation and service of food, which affects the quality and quantity of the food prepared, is another aspect of the industry that needs to be monitored for safety and efficiency.

Other aspects of industries outside of those relating to the processing and preparation of food, such as employee monitoring systems, chemical monitoring and testing equipment, utilities metering devices, smoke detection systems, and laundry/drying systems, require an apparatus for increasing efficiency and for monitoring user compliance with predetermined operating parameters.

SUMMARY OF THE INVENTION

It is therefore an object of the present invention to provide an efficient and effective apparatus for monitoring compliance by users with predetermined operating parameters.

In an aspect, the invention includes a sink monitoring device that includes an activation device for acknowledging an operator of a sink; a timing device for determining time of use data; a completion input device for generating wash completion data when the operator has completed use of the sink; and a memory storage device for storing operator data sets and predetermined frequency of use parameters of operators of a sink. The operator data sets include operator acknowledgment data, time of use data, and wash completion data. Also provided is a compliance controller coupled to the memory storage device. The compliance controller is configured to determine if the operator is in compliance with a predetermined sink use regimen by comparing the predetermined frequency of use parameters to the operator data sets. The compliance controller generates a non-compliance signal when an operator is no longer in compliance with the predetermined frequency of use parameter for the operator. The compliance controller is configured to couple to the plumbing of a sink to control the delivery of water to a sink. The sink monitoring device also includes a noncompliance warning device coupled to the compliance controller. The non-compliance warning device is configured to provide a non-compliance warning when the compliance controller generates a non-compliance signal.

In accordance with one aspect of the invention, a system is provided for monitoring use of an apparatus to determine compliance with operating parameters by users. The system includes a first data collection device for determining the identity of the user of the apparatus during each use for comparison to the operating parameters, a second data collection device for determining the time of use of the apparatus by the user during each use for comparison to the operating parameters, a third device for providing supplies or service to the user in a predetermined sequence, a collection data device for determining whether the person using the apparatus has completed the predetermined sequence, a monitor box mounted adjacent the apparatus including a device for evaluating compliance with the operating parameters by the person based on the determined identity of the person and the sequence completion information. Electronic communication links are provided between the compliance evaluating devices, whereby compliance with the operating parameters is evaluated based on the determined identity and operating parameters information from the apparatus. A central control device is located remote from the apparatus and is electronically connected to the monitor box for receiving downloaded information from the apparatus.

In accordance with another aspect of the invention, a system is provided for monitoring use of a plurality of apparatuses to determine compliance with operating parameters by a particular person. The system includes a plurality of apparatuses, each apparatus including a first data collection device for determining the identity of the user of the apparatus during each use for comparison to the operating parameters, a second data collection device for determining the time of use of the apparatus by the user during each use for comparison to the operating parameters, a third device for providing supplies or service to the user in a predetermined sequence, a collection data device for determining whether the person using the apparatus has completed the predetermined sequence, a monitor box mounted adjacent the apparatus including a device for evaluating compliance with the operating parameters by the person based on the determined identity of the person and the sequence completion information. Electronic communication links are provided between the compliance evaluating devices, whereby compliance with the operating parameters is evaluated based on the determined identity and operating parameters information from all of the apparatuses. A central control device is located remote from the apparatuses and is electronically connected to at least one of the monitor boxes for receiving downloaded information from the apparatus.

In accordance with another aspect of the invention, an apparatus is provided for monitoring use of a handsink to determine compliance with a use regimen by a user. The apparatus includes a first data collection device for determining the identity of the user of the handsink during each use for comparison to the use regimen, and a second data collection device for determining a time of use of the handsink by the user during each use for comparison to the use regimen. A device is provided for evaluating compliance with the use regimen by the user based on the determined identity of the user and the determined time of use.

In accordance with another aspect of the invention, a system is provided for monitoring use of a plurality of handsinks to determine compliance with a use regimen by a user. The system includes a plurality of first data collection devices, each of the first data collection devices being disposed proximate one of the handsinks for determining an identity of the user of the handsink during each use for comparison to the use regimen, and a plurality of second data collection devices, each of the second data collection devices being disposed proximate one of the handsinks for determining a time of use of the handsink by the user during each use for comparison to the use regimen. A device is provided for evaluating compliance with the use regimen by the user based on the determined identity of the user and the determined time of use obtained from any of the first and second data collection devices.

In accordance with yet another aspect of the invention, a system is provided for monitoring compliance with a cleansing regimen by a person. The system includes a plurality of cleansing stations, each station including a handsink, an identity data collection device for determining an identity of the person using the handsink, a washing control device for providing wash supplies to the handsink in a predetermined wash sequence, a washing data collection device for determining whether the person using the handsink has completed the wash sequence, a monitor box mounted adjacent the handsink including a device for evaluating compliance with the cleansing regimen by the person based on the determined identity of the person and the wash sequence completion information. Electronic communication links are provided between the compliance evaluating devices, whereby compliance with the cleansing regimen is evaluated based on the determined identity and wash sequence completion information from all of the handsinks. A central control device is located remote from the cleansing stations and is electronically connected to at least one of the monitor boxes for receiving downloaded information from the cleansing stations.

In accordance with yet another aspect of the invention, the system further includes a drying device for providing a means for drying the users hands as part of a predetermined wash sequence. Electronic communication means may also be provided between the compliance evaluating devices.

In accordance with another aspect of the invention, the system further includes a wash control device for providing wash supplies to the handsink in a predetermined wash sequence. The wash control device further includes an identity data collection device for determining the identity of the person using the wash control device and for determining compliance with the wash sequence.

In accordance with another aspect of the invention, an apparatus is provided for monitoring use of a handsink by a user to determine whether the user has complied with a use regimen. The apparatus includes a device for determining an identity of the user of the handsink during each use, a device for determining a time of use of the handsink during each use, and a device for evaluating compliance with the use regimen by the user based on the determined identity of the user and the determined time of use.

In accordance with another aspect of the invention, the apparatus may include an access unit connected over a communications link for on-demand user access to the status of the compliance data generated for each user by the device for evaluating compliance.

In accordance with yet another aspect of the invention, the apparatus may include an end-user access unit connected over a communications link for allowing the end-user to set, control, and change the use regimen or request status information for any component device of the system.

In accordance with other aspects of the invention, the apparatus may include a third data collection device for determining a completion of use of the handsink during each use for comparison to the use regimen, the determined completion being employed by the means for evaluating compliance, or the compliance evaluating device of the apparatus, upon determining a lack of compliance with the use regimen by the user, may generate a signal to indicate the lack of compliance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

It is to be understood that both the foregoing general description and the following detailed description are exemplary and explanatory only, and are not restrictive of the invention as claimed.

BRIEF DESCRIPTION OF THE DRAWINGS

The accompanying drawings which are incorporated in and constitute a part of the specification, illustrate the presently preferred embodiments of the invention and, together with the description, serve to explain the principles of the invention.

DETAILED DESCRIPTION OF THE PREFERRED EMBODIMENTS

Figure 1:
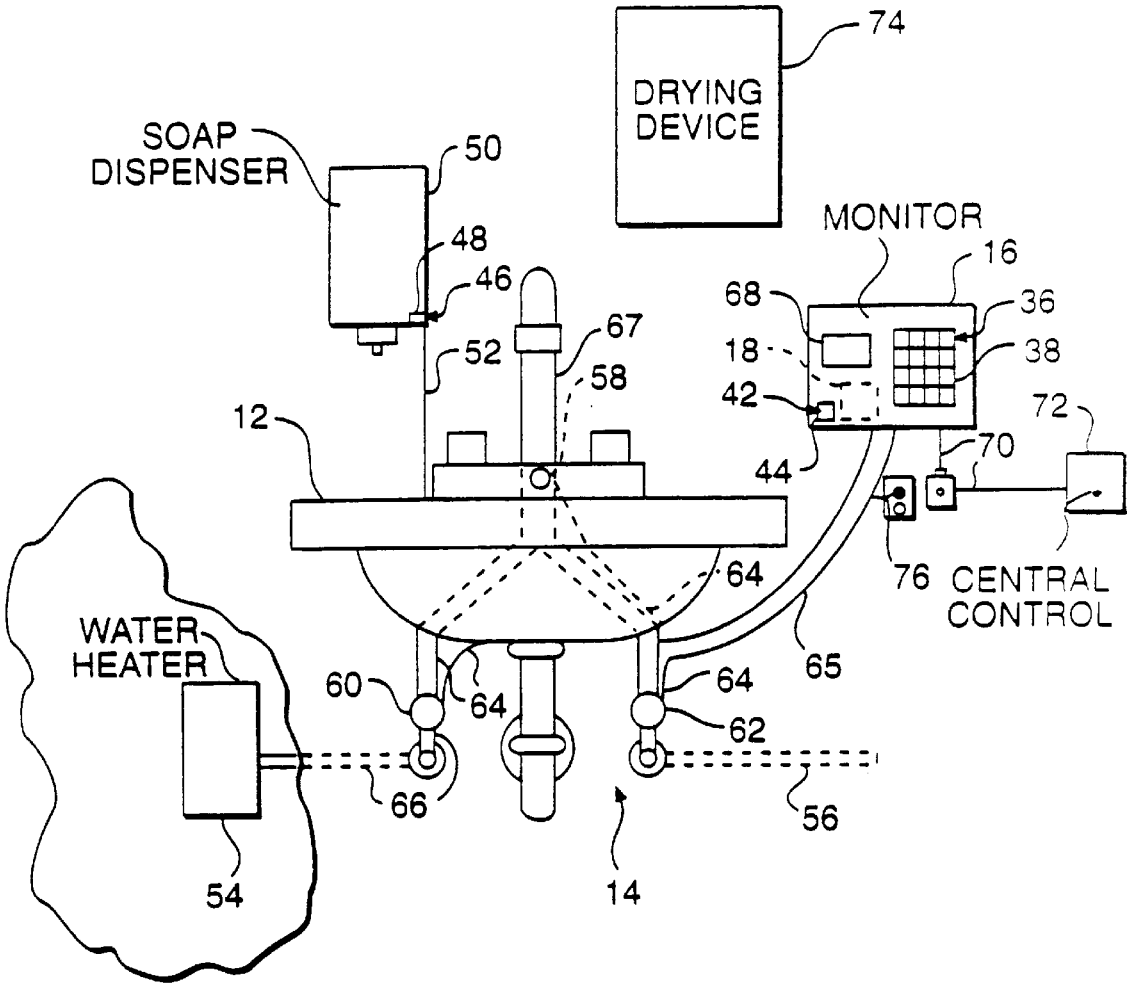
FIG. 1 is a front diagrammatical view of an apparatus according to a first embodiment of the present invention including a single handsink.

Reference will now be made in detail to the presently preferred embodiments of the invention, examples of which are illustrated in the accompanying drawings. In some instances, similar reference characters will be used in the drawings to refer to the same or like parts.

According to the present invention and as broadly embodied herein, an apparatus is provided for monitoring the use of a handsink to determine compliance with a use regimen by a user. As broadly shown in FIGS. 1 and 2, an apparatus 10 is provided for monitoring use of a handsink 12 connected to a water supply assembly 14 providing hot and cold water to the handsink. The apparatus 10 includes a monitor box 16 mounted adjacent the handsink 12. The monitor box 16 houses a controller 18, such as a general purpose computer, that controls the operation of the apparatus in response to sensed and input data.

Figure 3:
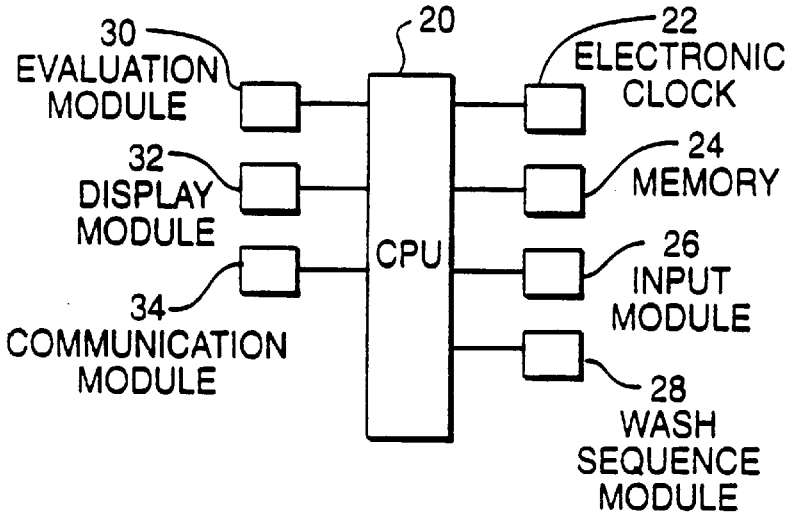
FIG. 3 is a diagram showing the interactive connections of various elements within the controller of the present invention.

As shown in FIG. 3, the controller 18 includes a central processing unit (CPU) 20, an electronic clock circuit 22, a memory 24, and a computer program, including an input module 26, a wash sequence module 28, an evaluation module 30, a display module 32, and a communication module 34. The operation of the apparatus 10, as directed by the controller 18 and its elements in response to various inputs, will be described in more detail below.

The handsink use regimen may be a cleansing regimen set forth in the FDA Food Code or any other government regulation, or may be any other specified regimen, and may have various predetermined parameters. For example, the cleansing regimen may require each user of the handsink to wash his or her hands at given intervals. Thus, the regimen may require a food service employee to wash every thirty minutes.

Alternately, the cleansing regimen may require each user of the handsink to wash his or her hands after specified events. Thus, the regimen may require a food service user to wash after using a bathroom, or may require a healthcare professional to wash after interacting with a patient.

The cleansing regimen may also specify a wash sequence including various steps, their duration, and their sequential order, such as wetting for five seconds, soaping and scrubbing for twenty seconds, and rinsing for five seconds. If all of the steps are not completed, the wash is considered incomplete, and compliance with the regimen is not achieved.

Alternately, the cleansing regimen may require different types of washes at different times or after certain events. Thus, a more thorough wash may be required periodically or after a bathroom visit.

The present invention is capable of monitoring compliance with each of the above variations in cleansing regimen either separately or simultaneously. However, it should be understood that the present invention is not limited to monitoring only the specified regimen variations discussed herein. Additionally, it should be understood that the present invention is not limited to monitoring handsinks, but may be utilized to monitor compliance with operating parameters for any system, including but not limited to: employee monitoring systems such as proximity sensing systems, personnel tracking systems, RF and bar code material tracking/personnel tracking systems, systems for controlling the quantity and quality of food, such as refrigeration systems, cooking equipment, appliance washing equipment, ice making equipment, and equipment systems for making frozen food; systems for monitoring use of equipment used for measuring and dispensing materials, such as temperature, pressure, and humidity measurement devices, chemical mixing and dispensing systems, laboratory testing equipment, centrifuge equipment, and gas monitoring systems; and other systems, including but not limited to laundry/drying systems, smoke detection/fire suppression systems, and other metering devices.

Figure 2:
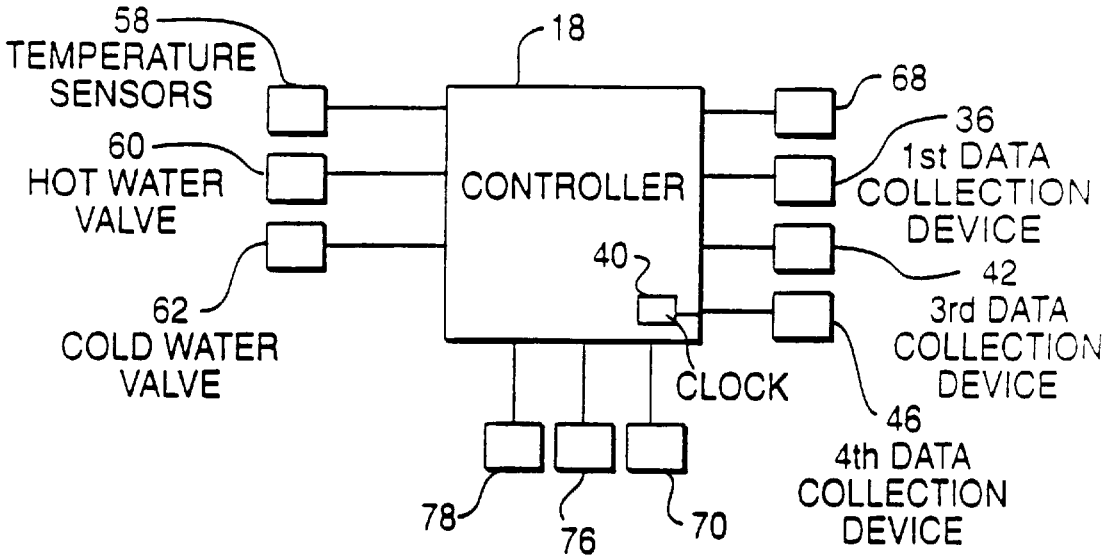
FIG. 2 is a diagram showing the interactive connections between the controller of the present invention and various inputs and outputs.

In accordance with the invention, a first data collection device is provided for determining an identity of the user of the handsink during each use for comparison to the use regimen. As shown in FIGS. 1 and 2, a first data collection device 36 is provided on the monitor box 16. Although the first data collection device 36 is shown in FIG. 1 as being mounted directly on the monitor box 16, the device 36 may be disposed anywhere near or as a component of the handsink so as to be convenient to users. The first data collection device 36 determines the identity of the user by receiving a code, specific to that particular user, each time that user uses the handsink 12.

Preferably, as shown in FIG. 1, the first data collection device 36 includes a keypad 38 to be operated by the user. The keypad 38 should be capable of receiving codes identifying the users and codes identifying wash types. Thus, the keypad 38 may be of any commonly available alphanumeric design known in the art.

Alternately, the first data collection device 36 may include bar code reader, a magnetic strip reader, a retinal scanner, a voice activation/recognition device, or any other suitable data collection or identifying device. If a bar code reader or magnetic strip reader is used as the first data collection device 36, a card or badge containing a bar code or magnetic strip, respectively, would be issued to each user. To indicate his or her identity, the user would place the bar code or magnetic strip in front of or into the reader to allow the first data collection device to determine the identity of the user.

An advantage of using a reader is that accidental or intentional entry of the wrong code by users is reduced, if not prevented, by requiring each user to carry a card or badge to be read by the reader.

An advantage of using a keypad 38 is that it allows a user to indicate his or her presence at the handsink 12 without having to worry about keeping a card or badge handy, and without requiring the employer to stock and program cards or badges for new employees. Direct identity entry into a keypad 38 is also desirable in environments where the user's hands may become extremely dirty, possibly dirtying a card or badge and interfering with a bar code, fingerprint, or magnetic strip reader.

Thus, different types of first data collection devices 36 may be selected within the scope of the present invention, depending on the intended environment and other factors. In its broadest sense, the present invention is not limited to use of any of the disclosed first data collection devices, and accordingly other suitable alternative devices may be employed.

Preferably, a second data collection device is provided for determining a time of use of an apparatus, for example a handsink, by the user during each use for comparison to the use regimen. As broadly embodied in FIGS. 1–3, the controller 18 disposed within the monitor box 16 includes a second data collection device 40 for determining a time of use of the handsink 12. The second data collection device 40 preferably automatically determines the time of use when the user uses the handsink 12 in order to prevent accidental or intentional entry of the wrong time by the user.

As shown in FIG. 3, the preferred second data collection device 40 is the electronic clock circuit 22 of the controller 18. The electronic clock circuit 22 continuously generates a time signal during the users' working hours. Each time that the first data collection device 36 is activated by the user, the time signal generated by the electronic clock circuit 22 is stored along with the identity of the user in the memory 24 of the controller 18. Thus, when the first data collection device 36 determines the identity of the user, the second data collection device 40 determines the time of the use, and the determined identity and time are stored together in the memory 24.

Preferably, a third data collection device is provided for determining a completion of use of the apparatus during each use for comparison to the use regimen. As broadly embodied in FIGS. 1 and 2, the apparatus 10 includes a third data collection device 42 for determining completion of use. As shown in FIG. 1, the third data collection device 42 is mounted on the control box 16 adjacent the handsink 12, although the device 42 could be disposed anywhere near or as a component of the handsink or other apparatus, so as to be convenient to the user. The third data collection device 42 preferably determines whether the user has completed use of the handsink 12 without requiring the user to make physical contact, in order to maintain cleanliness of the user's hands after cleansing.

As shown in FIG. 1, the third data collection device 42 preferably includes a photosensor 44 capable of detecting the presence of an object in its vicinity by detecting variations in ambient light. Alternately, the third data collection device 42 could be an infrared detector, or any other type of noncontacting sensor, within the scope of the present invention.

If the third data collection device is a photosensor 44, the photosensor can operate in at least two modes to determine and signal the completion of use of the handsink 12. In a first mode of operation, the photosensor 44 detects the presence of the user's hand within a few inches of the photosensor after completion of a wash sequence (i.e., for example, after the user has soaped, scrubbed, and rinsed his or her hands) and generates a completion signal in response. Thus, after the user completes the wash sequence, the user waves his or her hand in front of the photosensor 44 to indicate completion. If the user does not indicate the completion of the wash sequence by waiving in front of the photosensor 44, the photosensor will determine that the user is not still present and will not generate a completion signal.

In a second mode of operation, the photosensor 44 detects the presence of the user's body in front of the handsink 12 and generates a completion signal in response. In this mode, the photosensor 44 can either continuously attempt to detect the presence of the user throughout the wash sequence, or it can attempt to detect the presence of the user only after completion of the wash sequence. Thus, if used in the second mode, the sensitivity of the photosensor 44 should be such that it can detect objects several feet away. In the second mode, if the photosensor 44 detects the user in front of the handsink 12, either continuously or after completion of the wash sequence, the photosensor generates a completion signal. If the photosensor 44 detects that the user is not present in front of the handsink 12, either continuously or after completion of the wash cycle, no completion signal is generated.

As an option, the apparatus may also include a fourth data collection device for detecting cleaning agent use during each use of the handsink. As broadly shown in FIGS. 1 and 2, the apparatus 10 includes a fourth data collection device 46 for detecting cleaning agent use. As shown in FIG. 1, the fourth data collection device 46 preferably includes a vibration sensor 48 attached to a cleansing agent dispenser 50 mounted near the handsink 12. If a vibration sensor 48 is used as the fourth data collection device, it may include a piezoelectric sensor for detecting low frequency resonance caused by the user's contacting the cleansing agent dispenser to obtain cleansing agent. Alternately, other contact or noncontact sensors could be substituted for the vibration sensor 48, within the scope of the present invention. As shown in FIG. 1, the fourth data collection device 46 is electronically connected to the controller 18 via wiring 52. The fourth data collection device may alternatively be connected to the controller via any suitable communications link, for example by using a radio frequency transmitter/receiver or an infrared transmitter/receiver.

The dispenser 50 may also require the user to provide entry of user identification data prior to dispensing cleansing agent. In accordance with the invention, a second data collection device is provided for determining an identity of the user of the cleansing agent dispenser 50 during each use for comparison to the use regimen. A second data collection device (not shown) is provided on or near the dispenser 50. The second data collection device determines the identity of the user by receiving a code, specific to that particular user, each time that user uses the cleansing agent dispenser 50. Of course, similar to the first data collection device, varying types of second data collection devices may be selected within the scope of the present invention, depending on the intended environment and other factors.

As a further option, an additional dispenser (not shown) and a corresponding sensor and wiring may be provided. This dispenser could dispense sanitizer (or disinfectant) to be used after final rinsing. A fifth data collection device could sense whether a user had used the sanitizer after washing, and the wash regimen could require its use. Thus, the compliance evaluating device would also use the completion data gathered from the fifth data collection device to evaluate compliance with the wash regimen. A paper towel dispenser 74 is also shown in FIG. 1 for hand drying after cleansing. If desired, a hot-air dryer may alternatively be used. A sixth collection device could sense whether a user had used the towel dispenser 74 or drying device after washing, and the wash regimen could require its use. Additionally, the drying device may have a communications link with the cleansing agent dispenser 50. This communications link could comprise any suitable means, including for example, using a radio frequency transmitter/receiver or an infrared transmitter/receiver. As also shown in FIG. 1, an electrical power connection 76 is provided. A battery back-up may be provided within the monitor box 16 to maintain the memory 24 in case of interruption in electrical power supply.

Preferably, the wash supply assembly supplies wash materials to the handsink in a predetermined wash sequence. More preferably, the wash supply assembly includes a water supply for dispensing water of a predetermined temperature through a conduit to the handsink, and also includes a temperature sensor disposed in the conduit for measuring a temperature of the water prior to dispensing. Further, when the temperature sensor senses that the temperature of the water in the conduit is below the predetermined temperature, the wash supply assembly purges water from the conduit until the temperature sensor senses that the temperature of the water in the conduit has reached the predetermined temperature.

As broadly embodied in FIGS. 1 and 2, the wash supply assembly 14 includes a hot water supply 54, a cold water supply 56, a temperature sensor 58, flow control valves 60 and 62, and wiring 64 connecting the sensor 58 and valves 60 and 62 to the controller 18. The valves 60 and 62 are preferably solenoids controlled by the controller 18, and are preferably opened simultaneously during cleansing to provide mixed hot and cold water at or above the predetermined temperature. Alternately, a single solenoid could be provided downstream of the joinder of the hot and cold water supplies 54 and 56.

By positioning a water dechlorinator upstream from the mixing union for the hot and cold water lines and by positioning a water ozonator upstream from the mixing union on one of the water lines, a flow of dechlorinated, ozonated water may be dispensed to the user.

One or more wash sequences, as described above in connection with the cleansing regimens, may be stored in the memory 24 of the controller 18, which directs the various elements of the wash supply assembly 14 to carry out the wash sequences. For example, the controller 18 might direct the solenoids 60 and 62 to open for a period of time to wet the user's hands, direct the solenoids to close for a period of time to allow the user to scrub with a cleansing agent, and then direct the solenoids to open again for a period of time to allow the user to rinse off the cleansing agent. Closing the solenoids 60 and 62 during the scrubbing period advantageously conserves water and heating energy, as well as making the user wait to rinse, thereby likely increasing the actual scrubbing duration to the entire designated scrubbing period.

As a cleansing regimen may require that water of a predetermined (hot) temperature be provided to the user for effective cleaning, the controller 18 may direct the solenoids 60 and 62 to open periodically to purge water in the piping 66 and 67 between the hot water supply 54 and the handsink 12 that may have cooled to below the predetermined temperature. Preferably, the temperature sensor 58 detects the temperature of the water in the portion of the piping 67 downstream of where flows from the hot and cold water supplies 54 and 56 merge, and the controller 18 directs the solenoids 60 and 62 to open when the detected temperature is below the predetermined temperature. Alternately, only the hot water solenoid 60 may be opened to raise the water temperature at the temperature sensor 58, if desired. Once the temperature sensor 58 senses that the water in the piping 67 has reached or exceeded by a certain amount the predetermined temperature, the controller 18 directs the hot water solenoid or solenoids to close.

In accordance with the invention, a device is provided for evaluating compliance with the use regimen by the user based on the determined identity of the user and the determined time of use. As set forth in FIGS. 2 and 3, the compliance evaluating function is performed by the controller 18. Specifically, the CPU 20 and the evaluating module 30 of the controller 18 determine compliance with the use regimen based on the electronic clock signals generated by the electronic clock circuit 22, the cleansing regimen stored in the memory 24, and the identity of user data gathered by the first data collection device 36 (and the second data collection device of one embodiment of the invention) and input to the input module of the controller 18.

Preferably, the compliance evaluating device employs the completion information obtained by the third, or the fourth or fifth, data collection device to determine whether the user has complied with the operating parameters. As shown in FIGS. 2 and 3, the CPU 20 of the controller 18 evaluates compliance with the use regimen based on the completion information collected by the third or fourth data collection device 42 or 46 and input to the input module 26 of the controller. The CPU 20 and the evaluation module 30 determine, based on a comparison to the cleansing regimen stored in the memory 24, whether the user has complied with the cleansing regimen. Alternately, the compliance evaluating device may employ completion information from both the third and fourth data collection devices 42 and 46 to evaluate compliance with the cleansing regimen.

Preferably, the system may include an access unit for user access to the compliance data sets. The access unit (not shown) may be attached to one of the networked devices and allows the user to access the current status of any compliance data set on demand. The user may gain access to the access unit by any suitable means, including but not limited to a keypad, a card swipe device, retinal scanning, facial scanning, or fingerprint scanning, a voice activation system, a bar code device, an infrared receiver/transmitter, an ultrasonic receiver, or a radio frequency receiver. Once the user has accessed a particular compliance data set, he or she may have the requested information delivered in a variety of ways. For example, delivery may be from an offsite data collection system, by facsimile, by a local printer, by CRT, computer, or CPU, or via the Internet.

The system may also include an end-user access unit connected over a communications link allowing the end-user to set, control, and change the operating parameters or request status information for any component device of the system. The user may gain access to the end-user access unit (not shown) by any suitable means, including but not limited to a keypad, a card swipe device, retinal, facial, or fingerprint scanning, a voice activation system, a bar code device, an infrared receiver/transmitter, an ultrasonic receiver, or a radio frequency receiver.

Preferably, the means for evaluating compliance, upon determining a lack of compliance with the use regimen by the user, generates a signal to indicate the lack of compliance. As shown in FIGS. 1 and 2, a display element 68 is provided on the monitor box 16 for providing various information to the user. For example, the display element 68 may indicate to the user the identity code entered by the user or the time of use. Also, the display element 68 may signal a complete or an incomplete wash to the user, or may instruct the user as to the steps to follow in the wash sequence as the sequence progresses.

Preferably, the display element 68 indicates, based on the determined compliance with the cleansing regimen, as described above, that the user has not complied with the regimen. Thus, the display element 68 may flash a user's identity code and a signal such as "wash due" to alert the user and others that he or she has not complied with the wash regimen.

The display element may be a LCD display, and LED display, or any other suitable display. The CPU 20 and the display module 32 of the controller 18 direct the display element 68 to display information, based on various determinations made by the elements of the controller, as described above.

Preferably, the apparatus also included central control device located distant from the handsink and an electronic communication link between the compliance evaluating device and the central control device, the CPU directing the memory to periodically download stored data to the central control device. As shown in FIG. 1, a communication link 70 allows the controller 18 in the monitor box 16 to communicate to a central control device 72, which is a general purpose computer that can be located remote from the handsink. Periodically, the communication module 34 in the controller 18 can download the data stored in the memory 24 to the central control device 72. A download period may be, for example, a day, a week, a month, etc. Communication via the communication link 70 may be initiated either automatically, according to download period expiration, or manually, when desired, via either the central control device 72 or the CPU 20.

The central control device 72 can include a data processor, and all of the data gathered by the first through fourth data collection devices and all of the determinations made by the CPU, can be analyzed by the central control device 72. Based on the analysis, reports can be prepared listing users, user id's, and corresponding use frequency, type, and completion information. Preparation of the reports at the remote central control device location allows the information to be obtained without requiring maintenance of a printer or the like at the handsink location.

The communication link 70 may be any of a number of suitable communication devices. For example, the communication link 70 most preferably includes a telephone line, with a modem being housed in the monitor box 16 to allow communication with the central control unit 72. Alternately, the communication link 70 may include an Internet connection, a local area network or a wide area network, dedicated hardwired link, or a wireless system such as radio frequency telemetry or an infrared receiver/transmitter.

Alternately, the communication link 70 may be omitted if, for example, the monitor box 16 were to download data via a printer connection to printer for printing a hard copy of the data, or if data were stored on a disk, CD, or any other type of permanent media so that the data could be used by the central control unit 72 in the ways described above.

If desired, the central control unit 72 itself may also be omitted, and the sensed and compiled data may be manipulated by the controller 18 in the monitor box 16. Alternately, if desired, the remote central control unit 72 may be replaced by a local general purpose computer equipped to communicate with the monitor box 16.

Figure 4:
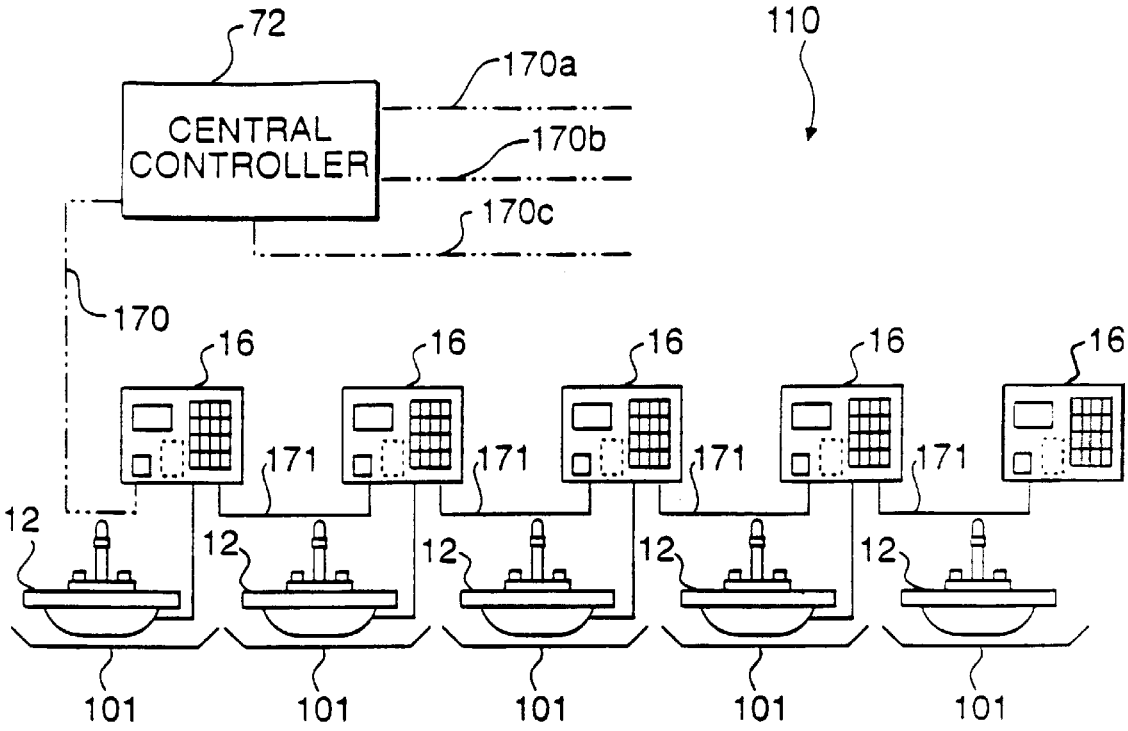
FIG. 4 is a diagrammatical view showing an apparatus according to a second embodiment of the present invention including multiple handsinks.
Figure 5:
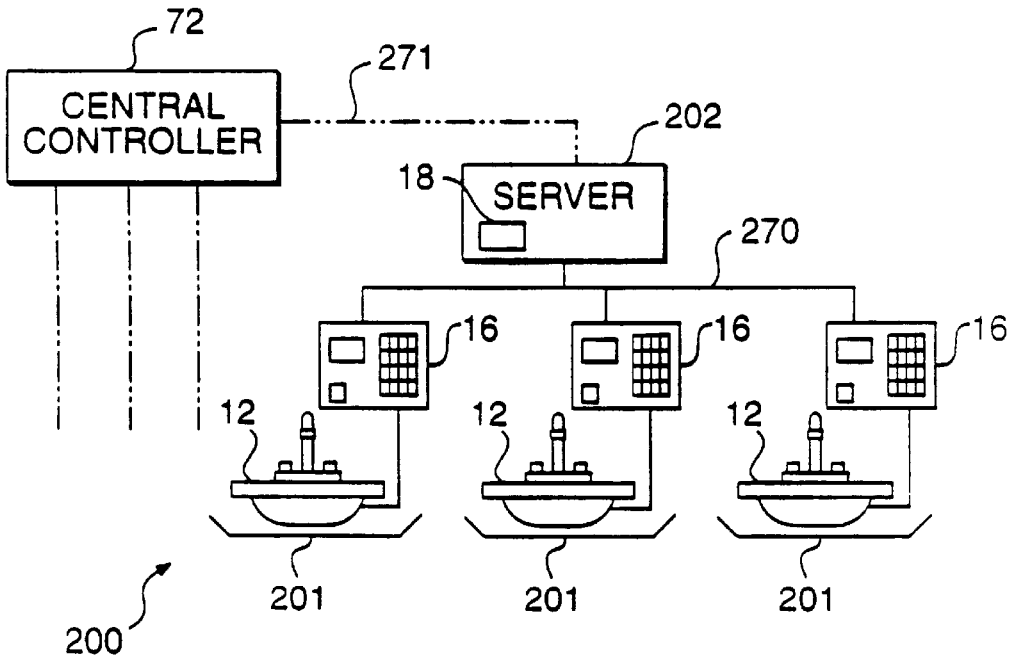
FIG. 5 is a diagrammatical view showing an apparatus according to a third embodiment of the present invention including multiple handsinks.

FIGS. 4 and 5 show alternate embodiments of the present invention in which a plurality of washing stations, each including a handsink, a monitor box, and a water supply assembly. As shown in FIG. 4, an apparatus 10 is provided having five cleansing stations 101, each including a handsink 12 and a monitor box 16, as described above. Each cleansing station 101 preferably includes the first through fourth data collection devices 36, 40, 42, and 46, as described above. As shown in FIG. 4, at least one of the cleansing stations 101 is electronically connected via a communication link 170 to a central control device 72, and all of the cleansing stations are connected to each other via wiring 171. Alternately, each of the cleansing stations 101 could be connected to the central control device 72 via separate communication links. As shown in FIG. 4, the central control device 72 may be connected to other groups of cleansing stations (not shown) by other communication links 170*a–c*.

In the device of FIG. 4, the controller of the leftmost cleansing station receives and evaluates data from the first through fourth data collection devices of all of the cleansing stations via wiring 171 and determines whether the user has complied with the wash regimen. The cleansing stations may be connected to each other by communication links such as an Internet connection, a local area network or a wide area network, dedicated hardwired link, or they may be connected by a wireless system such as by radio frequency telemetry or an infrared receiver/transmitter. The arrangement of FIG. 4 allows a user that works in a location having a plurality of cleansing stations to use different cleansing stations over time without having false "wash due" signals being displayed on any of the wash stations not being used.

FIG. 5 shows an alternate apparatus 210 in which a plurality of cleansing stations 201 are electrically connected by a communication link 270 to a server 202, which is in turn electrically connected by another communication link 271 to a central control device 72, as described above. The server 202 houses the controller 18, so that the data gathering and evaluation is performed in the server, rather than in one of the individual monitor boxes 16. Otherwise, the arrangement of FIG. 5 operates substantially similar to that of FIG. 4.

Figure 6:
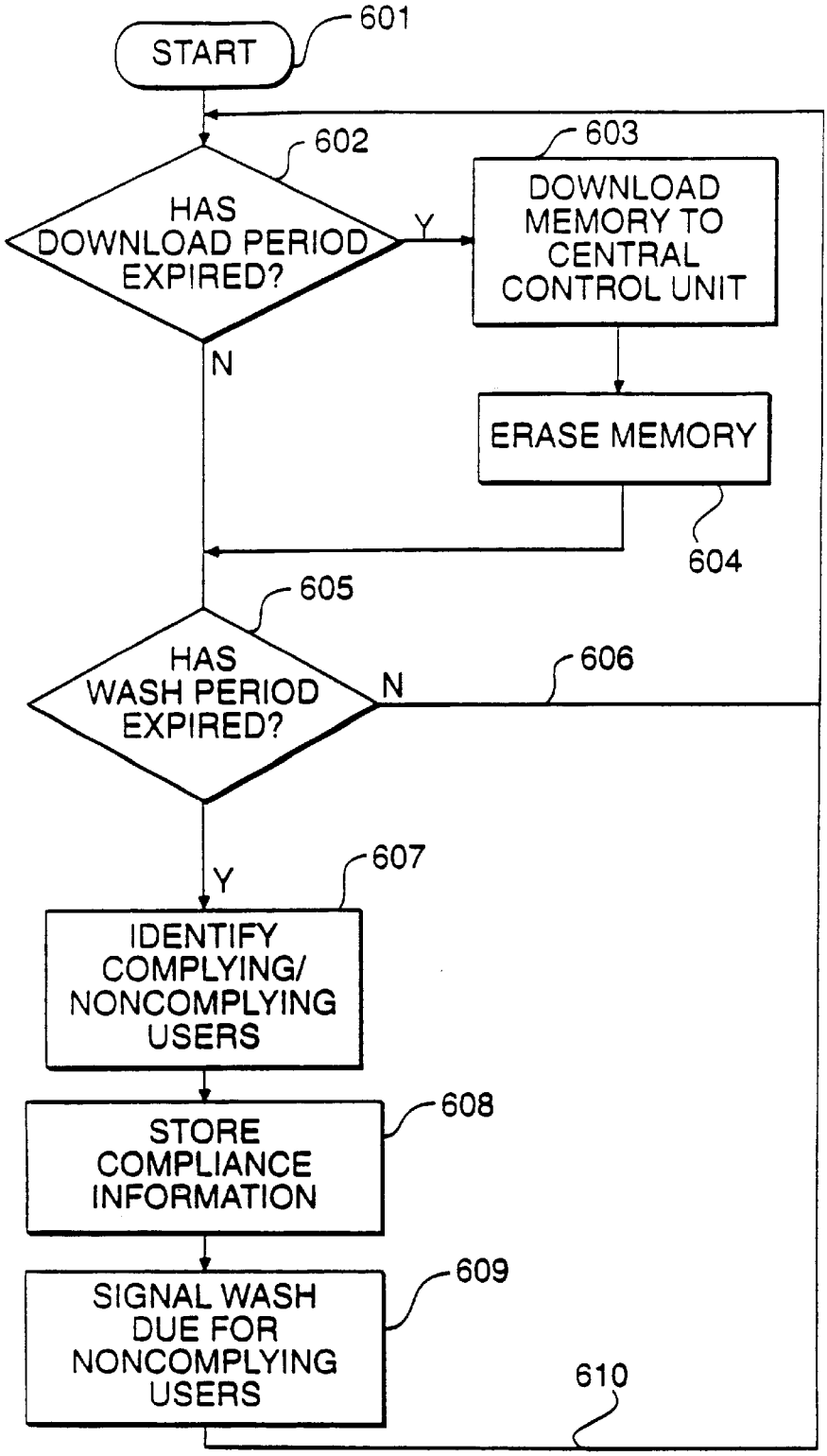
FIG. 6 is a flow chart showing operations of the present invention that occur at regular intervals according to download and wash period passage.
Figure 7:
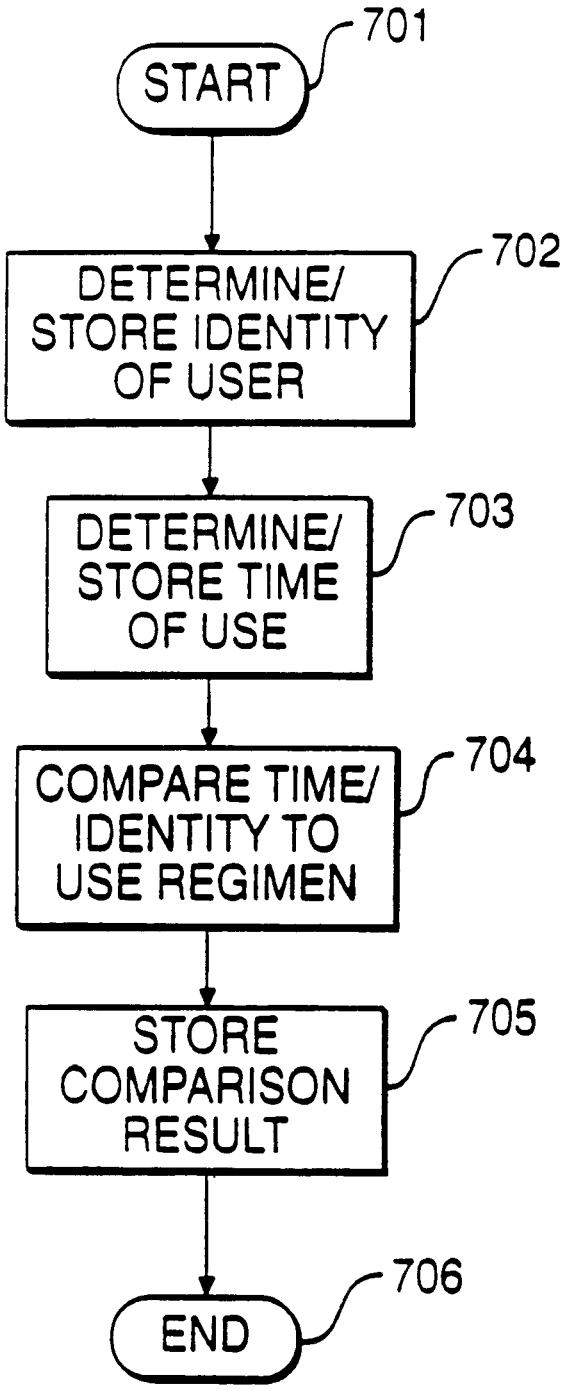
FIG. 7 is a flow chart showing operations of the present invention in response to data collected by the first and second data collection devices.
Figure 8:
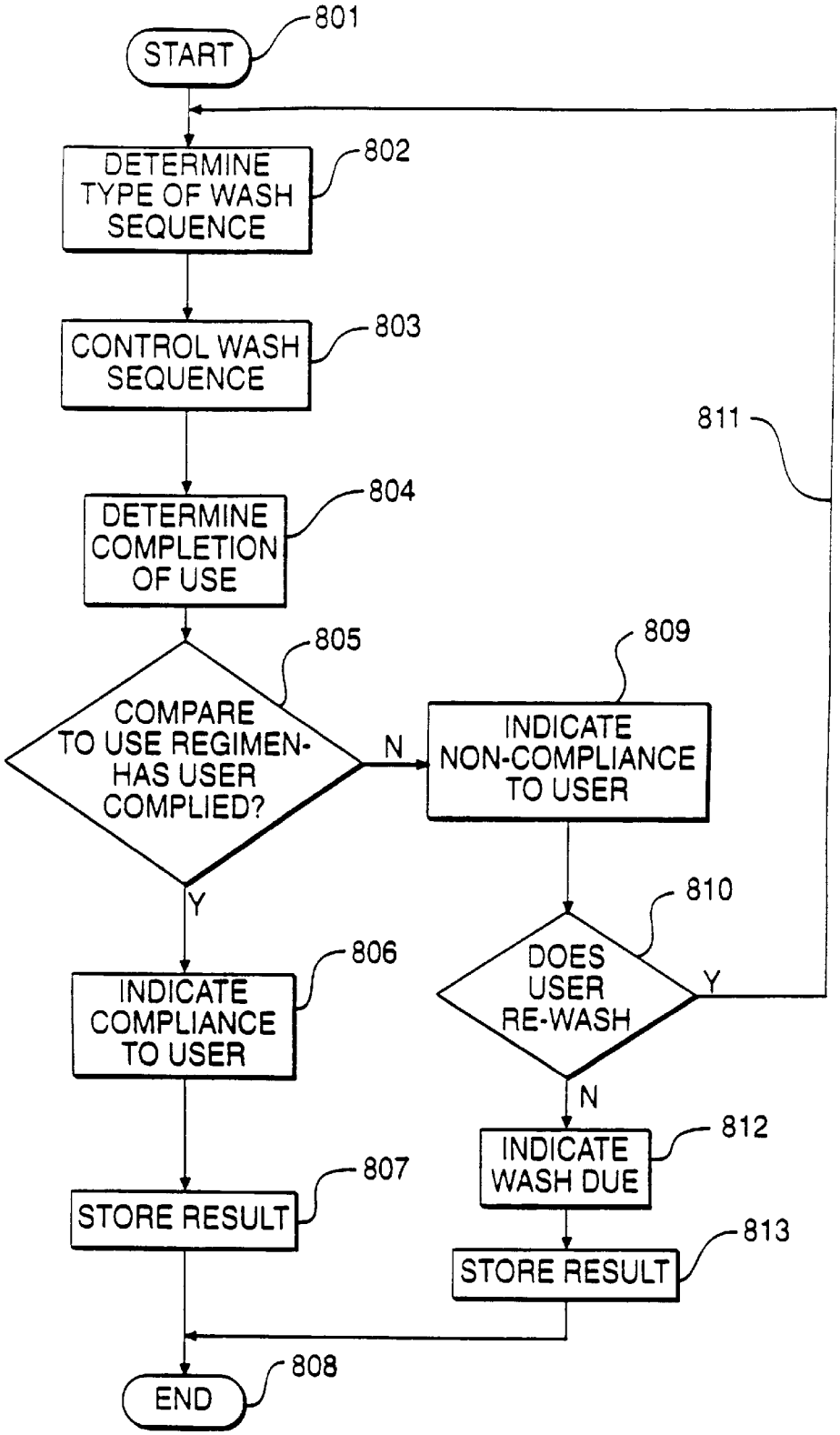
FIG. 8 is a flow chart showing operations of the present invention in response to data collected by the third and fourth data collection devices.

FIGS. 6–8 are flowcharts that further illustrate the operation of the present invention. FIG. 6 shows how the controller controls the downloading of information to the central control device and determines whether to generate wash due signals. Beginning at the "start" (601), assuming that a central control device 72 is employed, the CPU 20 and the evaluation module 30 determine (602) whether the download period has expired with reference to the electronic clock circuit 22. If the download period has expired (603), the CPU 20 and the communication module 34 download the memory 24 via the communication link 70 to the central control device 72. The CPU 20 then causes the memory 22 to be erased (604).

If the download period has not expired, or after the memory is erased, the CPU 20 and the evaluation module 30 determine (605) whether the wash period (a maximum permissible period between washes dictated by a wash regimen) has expired with reference to the electronic clock circuit 22. If not, the analysis begins again (606).

If the wash period has expired, the CPU 20, evaluation module 30, electronic clock circuit 22, and input module 26 identify complying and noncomplying users (607). The CPU 20 then directs the memory 24 to store the compliance information (608). The CPU 20 and the display module 32 then cause the display element 68 to indicate that noncomplying users have not complied with the cleansing regimen (609). At this point, the analysis begins again (610).

FIG. 7 shows the evaluation of compliance with the cleansing regimen based on determined user identity and time data. Beginning at the "start" (701), the first data collection device 36 determines the identity of the user, which the CPU 20 and input module 26 direct to be stored in the memory 24 (702). The second data collection device 40 determines the time of the use, which the CPU 20 and input module 26 direct to be also stored in the memory 24 (703). The CPU 20 and the evaluation module 30 then compare the identity and time data to the requirements of the cleansing regimen stored in the memory 24 (704). The CPU 20 directs that the result of the comparison be stored in the memory 24 (705), which ends (706) the analysis.

FIG. 8 shows the evaluation of compliance with the cleansing regimen based on determined completion of use data. Beginning at the "start" (801), the wash sequence is chosen from the memory 24 by the CPU 20 based on inputs from the user into the first data collection device 36 or based on a clock signal output by the electronic clock circuit 22 (802). The CPU 20 and the wash sequence module 28 then direct the water supply assembly 14 to provide cleansing supplies in the chosen wash sequence (803). The third and/or the fourth data collection devices 42, 46 then determine a completion of the use by the user (804). The CPU 20 and the evaluation module 30 then compare the completion of use data to the requirements of the cleansing regimen stored in the memory 24 (805).

If the user has complied, the CPU 20 and the display module 26 direct the display element 68 to indicate the compliance to the user (806). The CPU 20 directs that the result of the comparison be stored in the memory 24 (807), which ends (808) the analysis.

If the user has not complied, the CPU 20 and the display module 26 direct the display element 68 to indicate the lack of compliance to the user (809). The CPU 20 then determines whether the user initiates a rewashing (810). If the user does initiate a rewashing, the wash analysis begins again (811). If the user does not initiate a rewashing, the CPU 20 and the display module 26 direct the display element 68 to indicate the lack of compliance with the cleansing regimen to the user (812). The CPU 20 then directs that the result of the comparison to be stored in the memory 24 (813), which also ends (808) the analysis.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims and their equivalents.

What is claimed is:

1. A system for monitoring usage of a plurality of apparatuses by users, the system comprising:

a plurality of monitoring units, each monitoring unit comprising:

a display;

an activation device for acknowledging a user of the apparatuses;

a timing device for generating time of use data;

at least one ancillary input device for generating at least one ancillary signal upon user actuation of an ancillary device;

a completion input device coupled to said activation, timing, and at least one ancillary input devices, the completion input device generating a completion signal in response to a signal produced by the user, wherein user acknowledgment data, the time of use data, the at least one ancillary signal, and the completion signal comprise a user compliance data set; and a controller coupled to said completion input device and said display, said controller being configured to couple to the apparatus for controlling at least part of the operation of the apparatus;

one of said monitoring units further comprising:

a memory for storing said user compliance data set generated by said activation, timing, at least one ancillary input, and completion input devices of said one monitoring unit and the user compliance data sets generated by said activation, timing, at least one ancillary input, and completion input devices of at least one other monitoring unit;

a central processing unit programmed to compare each of said user compliance data sets with predetermined operating parameters assigned to each user and stored in said memory and to generate compliance/non-compliance data based on each comparison result for storage in said memory and for presentation to the users by said displays of said monitoring units, the predetermined operating parameters including at least frequency of use parameters; and a central unit connected over a communications link to receive down loadings of said user compliance data sets and said compliance/non-compliance data from said memory of said one monitoring unit.

2. The system of claim 1, wherein the plurality of monitoring units have means for communicating with each other and with ancillary devices.

3. The system of claim 2, wherein the plurality of monitoring units are located in proximity to the plurality of apparatuses.

4. The system of claim 3, wherein said means for communicating includes at least one of a radio frequency transmitter/receiver, an infrared transmitter/receiver, electrical wire, and telephone wire.

5. The system of claim 1, wherein the plurality of apparatuses are a plurality of sinks and the controller is configured to control the delivery of water to the plurality of sinks.

6. The system of claim 5, wherein the ancillary device is one of a product dispenser and a drying device.

7. The system of claim 6, wherein the ancillary device is a product dispenser chosen from a soap dispenser, a sanitizer dispenser, and a lotion dispenser.

8. The system of claim 7, further comprising:

a hot water line having a first flow control valve electrically connected to said controller;

a cold water line having a second flow control valve electrically connected to said controller;

a water spout connected to said hot and cold water lines by a mixing union downstream from said first and second flow control valves;

a water dechlorinator positioned upstream from said mixing union on said hot and cold water lines; and a water ozonator positioned upstream from said mixing union on one of said hot and cold water lines and downstream from said water dechlorinator;

wherein said controller controls said first and second flow control valves to produce a mixed flow of hot and cold dechlorinated, ozonated water through said water spout to the user's hands according to a wash sequence determined by a cleansing regimen assigned to each sink user stored in said memory.

9. The system of claim 8, wherein each monitoring unit further comprises a thermostat positioned downstream from said mixing union for electrically transmitting temperature input signals to said controller, said controller further controlling said first and second flow control valves in response to said temperature input signals to maintain a predetermined water temperature in preparation for each wash sequence.

10. The system of claim 5, further comprising a server connected in parallel over first communication links to each of said monitoring units, the server including a memory for storing the user compliance data sets generated by said activation device, timing device, at least one ancillary input device, and completion input device of each of said monitoring units and transmitted by said respective controllers over the first communication links, a central processing unit programmed to compare each of the user compliance data sets with a cleansing regimen assigned to each user and stored in the memory and to generate compliance/non-compliance data based on each comparison result for storage in the memory and for presentation to the users by said displays of said monitoring units, and a central unit connected to the server over a second communications link to receive down loadings of the user compliance data sets and the compliance/noncompliance data from the memory of the server.

11. The system of claim 5, further comprising an access unit for user access to said user compliance data sets.

12. The system of claim 5, further comprising an end-user access unit connected over a communications link to permit an end-user to access user compliance data sets and to access and alter the predetermined operating parameters.

13. The system of claim 5, wherein the controller is configured to couple to the water supply of a standard sink.

14. The system of claim 1, wherein the at least one ancillary input device includes first and second ancillary input devices, the first ancillary input device generating a first ancillary signal upon user actuation of a first ancillary device and the second ancillary input device generating a second ancillary signal upon user actuation of a second ancillary device.

15. The system of claim 14, wherein the plurality of apparatuses are a plurality of sinks, the controller is configured to control delivery of water to the sinks, the first ancillary device is a product dispenser, and the second ancillary device is a drying device, and wherein the first ancillary input device generates a first signal upon user actuation of the product dispenser and the second ancillary input device generates a second signal upon user actuation of the drying device.

16. The system of claim 15, wherein the first and second ancillary input devices communicate with each other using one of a radio frequency transmitter/receiver, an infrared transmitter/receiver, and wire.

17. The system of claim 1, wherein the plurality of apparatuses are a plurality of sinks, and wherein the activation device is an identification device for acknowledging and identifying at least one user of at least one of the sinks when the at least one user enters user identification data into the identification device.

18. A monitoring unit for monitoring usage of an apparatus by users, the monitoring unit comprising:

a display;

an activation device for acknowledging a user of an apparatus;

a timing device for generating time of use data;

an ancillary input device for generating an ancillary signal upon user actuation of an ancillary device;

a completion input device coupled to said activation, timing, and ancillary input devices, the completion input device generating a completion signal in response to a signal produced by the user, wherein user acknowledgment data, the time of use data, the ancillary signal, and the completion signal comprise a user compliance data set;

a controller coupled to said completion input device and said display, wherein said controller is configured to couple to the apparatus for controlling at least part of the operation of the apparatus;

a memory for storing said user compliance data set generated by said activation, timing, ancillary input, and completion input devices of said monitoring unit;

a central processing unit programmed to compare each of said user compliance data sets with predetermined operating parameters assigned to each apparatus user and stored in said memory and to generate compliance/non-compliance data based on each comparison result for storage in said memory and for presentation to the users by said display, the predetermined operating parameters including at least frequency of use parameters; and a central unit connected over a communications link to receive down loadings of said user compliance data sets and said compliance/non-compliance data from said memory.

19. The monitoring unit of claim 18, wherein the apparatus is a sink, and wherein the activation device is an identification device for acknowledging and identifying at least one user of the sink when the at least one user enters user identification data into the identification device.

20. A sink monitoring device comprising:

an activation device for acknowledging an operator of a sink;

a timing device for determining time of use data;

a completion input device for generating wash completion data when the operator has completed use of the sink;

a memory storage device for storing operator data sets and predetermined frequency of use parameters for operators of the sink, the operator data sets including operator acknowledgment data, time of use data, and wash completion data;

a compliance controller coupled to the memory storage device, the compliance controller being configured to determine if the operator is in compliance with a predetermined sink use regimen by comparing the predetermined frequency of use parameters to the operator data sets, the compliance controller generating a non-compliance signal when an operator is no longer in compliance with the predetermined frequency of use parameter for the operator, wherein the compliance controller is configured to couple to the plumbing of the sink to control the delivery of water to the sink; and a non-compliance warning device coupled to the compliance controller, the noncompliance warning device being configured to provide a non-compliance warning when the compliance controller generates a non-compliance signal.

21. The sink monitoring device of claim 20, wherein the activation device is an identification device for acknowledging and identifying the operator of the sink when the operator enters operator identification data into the identification device.

22. The sink monitoring device of claim 20, further comprising an ancillary input device for generating an ancillary signal upon operator actuation of an ancillary device, the ancillary input device being coupled to the completion input device, wherein the completion input device will not generate a wash completion signal unless the ancillary input device has generated an ancillary signal during operation of the sink.

23. The sink monitoring device of claim 22, wherein the ancillary input device is coupled to a product dispenser, the ancillary input device being configured to generate an ancillary signal when the operator uses the product dispenser.

24. The sink monitoring device of claim 23, wherein the product dispenser is one of a soap dispenser, a sanitizer dispenser, and a lotion dispenser.

25. The sink monitoring device of claim 22, wherein the ancillary input device is coupled to a drying device, the ancillary input device being configured to generate an ancillary signal when the operator uses the drying device.

26. The sink monitoring device of claim 25, wherein the drying device is one of an air dryer and a towel dryer.

27. The sink monitoring device of claim 20, wherein the memory storage device stores non-compliance data generated by the compliance controller.

28. The sink monitoring device of claim 27, further comprising a central unit coupled to the memory storage device, the central unit being configured to receive down loadings of the operator data sets and the non-compliance data.

29. The sink monitoring device of claim 20, wherein the completion input device is one of a product dispenser and a sensor.

30. The sink monitoring device of claim 20, wherein the compliance controller is configured to couple to the water supply of a standard sink.

31. The sink monitoring device of claim 20, further comprising a flow control valve electrically connected to said compliance controller, said flow control valve being coupled to plumbing of a sink downstream of a mixing union that mixes hot and cold water lines provided to a sink, wherein said compliance controller is configured to actuate said flow control valve to provide a mixture of hot and cold water to a sink.

32. A system for monitoring a plurality of sinks, the system comprising:

a primary sink monitoring device including the sink monitoring device of claim 27, and at least one secondary sink monitoring device coupled to the memory storage device of the primary sink monitoring device, the at least one secondary sink monitoring device including an activation device for acknowledging an operator of a secondary sink, a timing device for determining time of use data, a completion input device for generating wash completion data when the operator has completed use of the secondary sink, the memory storage device of the primary sink monitoring device further storing operator data sets from the secondary sink monitoring device, and a wash controller for controlling the delivery of water to a secondary sink.

33. The system of claim 32, further comprising a central unit coupled to the memory storage device, the central unit being configured to receive down loadings of the operator data sets and non-compliance data from the memory storage device.

34. The system of claim 32, wherein the primary sink monitoring device further comprises a primary flow control valve electrically connected to said compliance controller, said primary flow control valve being coupled to plumbing of a sink downstream of a mixing union that mixes hot and cold water lines provided to a sink, wherein said compliance controller is configured to actuate said primary flow control valve to provide a mixture of hot and cold water to a sink.

35. The system of claim 34, wherein the secondary sink monitoring device further comprises a secondary flow control valve electrically connected to said wash controller, said secondary flow control valve being coiled to plumbing of a secondary sink downstream of a mixing union that mixes hot and cold water lines provided to a secondary sink, wherein said wash controller is configured to actuate said secondary flow control valve to provide a mixture of hot and cold water to a secondary sink.

36. The system of claim 32, wherein the secondary sink monitoring device further comprises a secondary flow control valve electrically connected to said wash controller, said secondary flow control valve being coupled to plumbing of a secondary sink downstream of a mixing union that mixes hot and cold water lines provided to a secondary sink, wherein said wash controller is configured to actuate said secondary flow control valve to provide a mixture of hot and cold water to a secondary sink.

37. A method of monitoring usage of at least one sink, the method comprising:

providing a sink monitoring device associated with at least one sink, the sink monitoring device being configured to control water flow to the at least one sink, to identify at least one operator of the at least one sink, to determine the time when the at least one operator uses the at least one sink, to store operator identity data, time of use data, and a predetermined frequency of use parameter, and to provide an alert when the at least one operator is not in compliance with a predetermined use regimen;

identifying the at least one operator of the at least one sink when the at least one operator uses the at least one sink;

storing the time when the at least one operator uses the at least one sink;

determining if the at least one operator is in compliance with the predetermined use regimen by comparing time elapsed since the at least one operator last used the at least one sink with the predetermined frequency of use parameter stored in the sink monitoring device; and providing an alert of non-compliance of the predetermined sink use regimen by the at least one operator when time elapsed since the at least one operator last used the at least one sink exceeds the predetermined frequency of use parameter.

38. The method of claim 37, wherein the usage of the at least one sink comprises:

turning on the water of the at least one sink for a first predetermined amount of time after identifying the at least one operator of the at least one sink;

turning off the water of the at least one sink after the first predetermined amount of time has passed and waiting for a second predetermined amount of time;

turning on the water of the at least one sink after the second predetermined amount of time has passed for a third predetermined amount of time;

turning off the water of the at least one sink after the third predetermined amount of time has passed; and storing completion of use data in the at least one sink monitoring device after the at least one operator has acknowledged completion of use of the at least one sink.

39. A method of monitoring usage of at least one sink, the method comprising:

providing a sink monitoring device associated with at least one sink, the sink monitoring device being configured to control water flow to the at least one sink, to determine the time elapsed since an operator last used the at least one sink, and to store at least one predetermined frequency of use parameter;

storing the time when the at least one sink is used by an operator;

comparing the time elapsed since the at least one sink was last used to the at least one predetermined frequency of use parameter; and providing an alert signal when the time elapsed since the at least one sink was last used exceeds the at least one frequency of use parameter.

40. The method of claim 39, wherein usage of the at least one sink comprises:

turning on the water of the at least one sink for a first predetermined amount of time;

turning off the water of the at least one sink after the first predetermined amount of time has passed and waiting for a second predetermined amount of time;

turning on the water of the at least one sink after the second predetermined amount of time has passed for a third predetermined amount of time;

turning off the water of the at least one sink after the third predetermined amount of time has passed; and storing completion of use data in the sink monitoring device after an operator has acknowledged completion of use of the at least one sink.

* * * * *